United States Patent [19]

Williams et al.

[11] 4,203,239

[45] May 20, 1980

[54] PICTURE HOLDER

[76] Inventors: Alice J. Williams, 19 Marlton; Martha D. Gregory, 18 Marlton, both of Gibbsboro, N.J. 08026

[21] Appl. No.: 818,452

[22] Filed: Jul. 25, 1977

[51] Int. Cl.[2] ..... G09F 1/10; G09F 1/12

[52] U.S. Cl. ..... 40/152.1; 40/124.2; 40/19.5; D6/188; 211/50; 211/58

[58] Field of Search ..... 40/124 R, 124.4, 124.2, 40/19.5, 152.1, 605, 606, 607, 473, 501, 10; 211/50, 58, 52, 56; 248/529, 165; 428/14, 19; D6/140, 188, 28

[56] References Cited

U.S. PATENT DOCUMENTS

| | | | |
|---|---|---|---|
| D. 157,082 | 1/1950 | Patton | D6/140 X |
| 716,261 | 12/1902 | Merton | 40/124.2 X |
| 3,040,459 | 6/1962 | Marcy | 40/124.4 |
| 3,091,046 | 5/1963 | Engelstein et al. | 40/159 X |
| 4,026,417 | 5/1977 | Streim et al. | 211/58 X |

FOREIGN PATENT DOCUMENTS

| | | | |
|---|---|---|---|
| 1926382 | 12/1970 | Fed. Rep. of Germany | 40/159 |
| 1312508 | 11/1961 | France | 40/124.4 |

*Primary Examiner*—Richard C. Pinkham
*Assistant Examiner*—Scott L. Brown
*Attorney, Agent, or Firm*—Thomas A. Lennox

[57] ABSTRACT

A picture holding device injection molded of clear plastic is provided wherein a plurality of profile shapes with opposing channels are interconnected so as to allow a number of transparent picture holding sleeves to be inserted in the channels. The channels are separated horizontally and vertically so as to provide an essentially unobstructed view of each picture by merely changing the viewing angle.

8 Claims, 11 Drawing Figures

PICTURE HOLDER

BACKGROUND OF THE INVENTION

This device generally relates to the problem of holding separate pieces of paper, plastic, sheet, or like material which have thereon pictures, signs, designs, letters, numbers and the like hereinafter referred to as "pictures", not easily displayed or sorted without some device. There is a continuing need for a device to display, hold, and protect such pictures. It has also become popular to collect such pictures, particularly including photographs, playing cards, stamps, baseball cards and the like and there has been a great need to have a device that will hold, protect and display these pictures, all at the same time. In particular, there is a need for a device that will hold pictures and memorabilia of varying sizes. Photographs are printed in a variety of sizes and are not always obtained from the same source. Thus, for example, a gift of a photograph from a loved one may typically be from a 126 size camera and will hardly fit in an album or display device which the receiver has provided for his or her own 110 size photographs. Likewise, cropping of photographs to an odd size does not fit the standard size display unit. School photographs are typically a different size from the photographs taken with the camera owned by the typical family. As a consequence, these photographs, while of great sentimental value, can hardly ever be displayed in the same photograph album or device which the family owns. In addition, it is sometimes desired to combine special collections such as magazine pictures or trading cards along with photographs in the same display device. As a consequence, there is a great need to provide a device which has the versatility to allow insertion of such pictures of varying sizes into the same display device. The device may be chosen to display the size of the majority of the pictures to be displayed but should offer the versatility of holding other sized pictures.

It is therefore an object of this invention to provide a picture holder, suitable for holding any and all of such pictures and allow viewing of a large number of pictures by merely changing the viewing angle.

It is another object of this invention to provide a holder which is capable of using individual protecting sleeves containing the pictures but will allow easy removal of the sleeves with the pictures still inside and replacement thereof with other sleeves containing other pictures.

It is an additional object of this invention to provide a device that fully protects the pictures held and displayed in the device.

It is an additional object of this invention to provide a device that protects the edges, face and back of the pictures so displayed and yet allows their easy removal and continuous viewing thereof.

It is an additional object of this invention to provide a device that allows display of pictures of varying sizes or in the alternative pictures of all the same size depending upon an adjustment of the construction of the device.

In particular, it is an object of this invention to provide a photograph holder which will allow display of photographs of varying sizes and shapes along with other items of memorabilia and sentiment to display a collage of pictures in a fully protected and fully displayable device.

It is a further object of this invention to provide a device which may be constructed of a number of identical parts so as to reduce the number of shapes required to form a picture holding display device.

It is a further object of this invention to provide a picture display device wherein each picture is separately held in a sleeve for ready and easy removal without damaging or affecting the display device in any way whatsoever and without dislodging the other pictures held in the device.

DESCRIPTION OF PRIOR ART

A number of devices are available for holding pictures such as photographs and cards. A typical method of storing photographs is in albums. Some have sleeves in which the photographs are inserted. In this type, the sleeves are typically not easily removed and replaced in the album, without removing the pictures from the sleeves and there is only a limited number of pictures in view at any one time. In addition, the photograph album is not decorative and the sleeve type album holds only one size photograph or cards.

There are photograph albums utilizing self-adhering transparent sheets on which can be mounted photographs of varying sizes. However, when one photograph is removed all of the photographs are loose and the album suffers from all of the other deficiencies listed above.

Clear plastic cubes have been available which display up to six photographs although only five photographs are visible when the cube is lying flat on a surface. The cube device is limited in that one photograph cannot be removed without upsetting the other photographs and it has a limited capacity.

There are a number of devices which hold photographs or cards in a three dimensional arrangement. These include a variety of card holders described in U.S. Pat. Nos. Des. 181,006 to William Taylor Jones; Des. 157,082 to John P. Patton; and Des. 241,394 to Melba C. Widdowson. All of these devices utilize slots in which one edge of the card is inserted and held without providing protection or suitable display.

U.S. Pat. Nos. 2,503,359 to H. W. Smith; 2,865,122 to W. L. Clawson and 3,987,566 to Anthony J. March disclose tree shaped devices to hold cards, from one card edge or one corner without protection and without adequate display. None of these devices are suitable for holding photographs or other important pictures.

U.S. Pat. No. 3,040,459 to J. P. Marcy, discloses a display rack for greeting cards held by the lower edge of the card such tha the card is self supporting from the edge. U.S. Pat. Nos. 3,483,742 to H. A. Murray and 3,581,419 to Robert S. McCracken both disclose tree shaped devices wherein an edge of the card is inserted in a slit to hang without support or protection.

None of the devices and articles described above satisfy the objects of this invention and none offer the advantages and characteristics of the invention described hereinbelow.

SUMMARY OF THE INVENTION

This invention is directed to a picture holder and display device. The invention satisfies the above objects by interconnecting at least three profile members to form a three dimensional shape having the profile members extending radially outwardly to form spaces between these profile members. A plurality of sleeve holding members, at least one on each face of each profile member, are positioned to hold sleeves in the spaces between the profile members. It is preferred that there be at least one and more preferably a plurality of channels on each face of the profile members. The channels are positioned so that each channel has another channel across the space from it in a like position on the opposing face of adjacent profile member. Where there is a plurality of channels on each face, the channels are preferably horizontally spaced apart so as to provide for individual sleeves to be easily inserted in the channel pairs. The distance between the bottom of the channels on the same face are vertically spaced to provide that portion of the sleeve desired to be viewed above or below adjacent sleeves. The channels are horizontally and vertically spaced so as to provide an essentially unobstructed view from at least one angle of the desired portion of the picture held in the sleeve. Individual sleeves suitable for holding pictures are inserted and framed on both sides in the channel pairs so as to protect and display the pictures.

DESCRIPTION OF PREFERRED EMBODIMENTS

Figure 1:
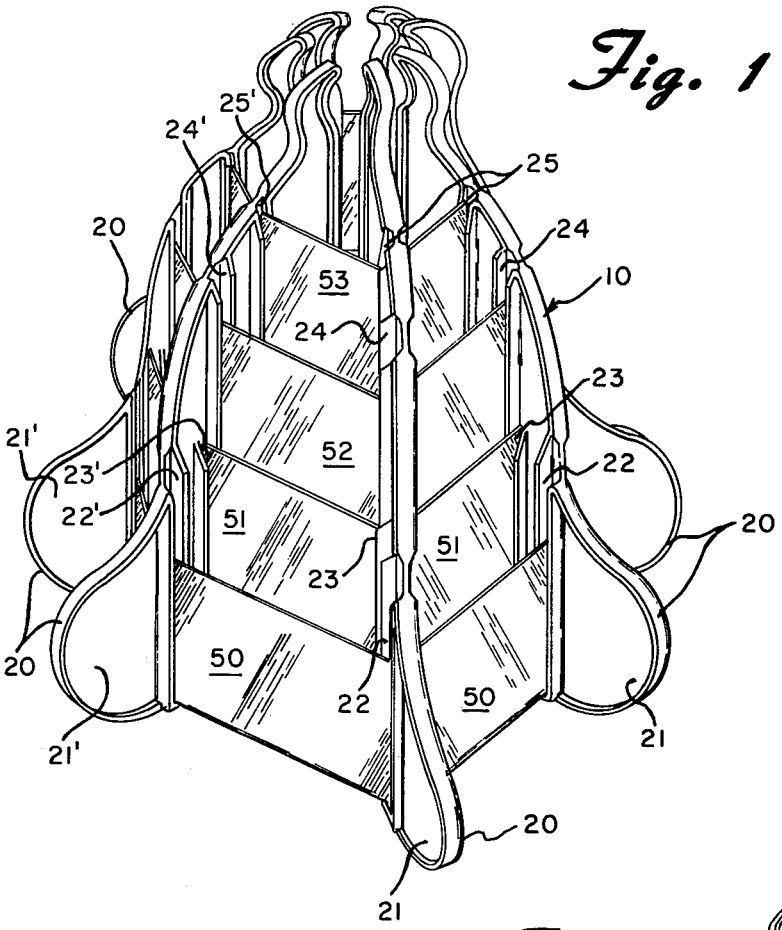
FIG. 1 is a perspective view of a picture holding device of this invention wherein transparent sleeves suitable for holding pictures have been inserted to show the display capability of the device.

A preferred embodiment of this invention is illustrated in FIG. 1 and the additional accompanying Figures. Picture holder 10 is constructed of seven identical profile shapes 20, one being mostly hidden except for the top-most portion. Each profile shape 20, generally in the shape of one-half a bell, has on right face 21 a total of four separate right channels 22, 23, 24 and 25 and on left face 21' four left channels 22', 23', 24', and 25'. When profile shapes 20 are interconnected to form picture holder 10, opposite opposing channels 22 add 22' are in position to allow picture sleeve 50 to slide into the opposing channels thus framing pictures held in sleeve 50. Similarly, picture sleeve 51 is held by left channel 23' and right channel 23; picture sleeve 52 is held between left channel 24' and right channel 24; and sleeve 53 is held between left channel 25' and right channel 25. Picture holder 10 has the capacity to hold 28 pictures in the 28 sleeves. As above, pictures include photographs, cards, drawings, lettering and the like, none of which are shown so as to prevent the figures from being overly cluttered.

As will be apparent, this invention may utilize any number of profile shapes of at least three in number, it being preferred that the number of profile shapes be in the range of 4 to 9, and it is more preferred that there be 6 to 8 profile shapes. Each profile shape may hold any number of sleeves depending upon the size and shape of the pictures or drawings to be framed, and the size and shape of the profile shape. For example, particularly where photographs are to be inserted in picture holder 10, it is preferred that each profile shape face have the capacity to hold 2 to 10 photographs. Thus, for the preferred picture holder having 4 to 9 profile shapes, the capacity for picture holder 10 is in the range of 8 to 90 photographs.

An alternate means of holding the sleeves in the space between the profile shapes is to provide holes, cups or channels on the adjacent faces. Wires or plastic rods inserted through the sleeves cut to the proper length are inserted in the holes, etc., and hang the sleeve in the space. Another method is to cut an extention on the sleeves in the shape, for example, of a hook which may attach and disattach from overhangs on the faces of the profile shapes. Other holding means are contemplated, to hold the sleeves across the pie shaped spaces.

Figure 2:
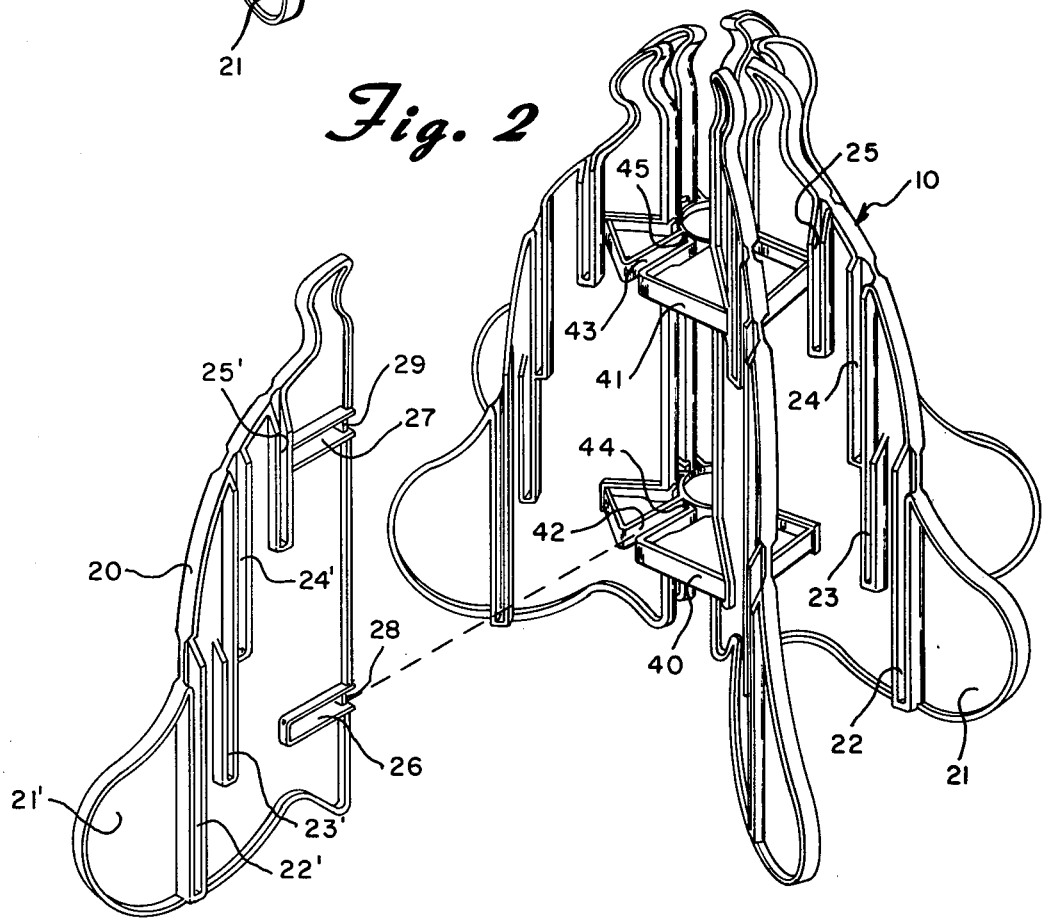
FIG. 2 is a partially exploded perspective view of a picture holder ofthis invention showing how the device is interconnected together from its component parts and where the picture sleeves are inserted.

Picture holder 10 is illustrated in FIG. 2 without sleeves 50 through 53 in place. In addition, one of the identical profile shapes 20 has been removed horizontally to better show the internal construction of this embodiment. The construction of four left channels 22', 23', 24', and 25' on left face 21' are shown on the profile shape 20 that is shown removed from picture holder 10. Similarly, the entire right channels 22, 23, 24 and 25 are shown on a right face 21. Other channels are shown but are somewhat distorted by the viewing angle necessary for the perspective view. As illustrated, each profile shape 20 is interconnected to the other identical profile shapes 20 through lower interconnecting hub 40 and upper interconnecting hub 41. In this embodiment, interconnecting hubs 40 and 41 are identical and interconnect with profile shapes 20 in the same fashion at different positions. Interconnection between profile shape 20 and lower interconnecting hub 40 is made through lower complimentary slot 26 on profile shape 20 which interfits with one of complimentary slots 42 on hub 40. The number of slots 42 correspond with the number of shapes 20 to be interconnected and visa versa. Similarly, upper complimentary slot 27 interconnects with one of slot 43 of upper interconnecting hub 41. Similarly, each profile shape 20 interconnects through interfitting slots at the two positions to form picture holder 10.

In the preferred embodiment, interlocking lugs 28 and 29 are provided on profile shape 20 to interlock with spring dentent locking lugs 44 and 45 on hubs 40 and 41 respectively. Thus, when profile shapes 20 are interfitted through slots 26 and 27 into slots 42 and 43 of interconnecting hubs 40 and 41 all of the parts are interlocked together. Picture holder 10 may be disassembled by disconnecting the parts by depression of dentent spring lugs 44 and 45.

Figure 3:
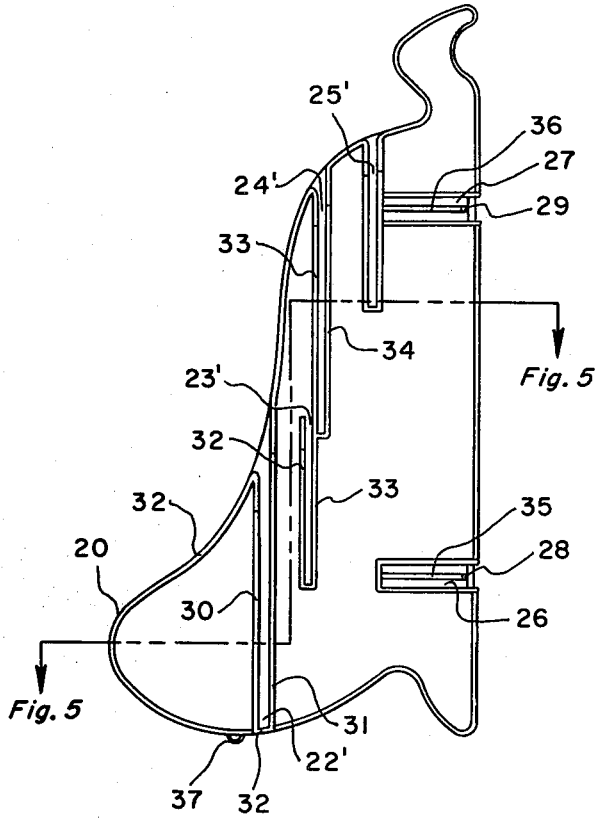
FIG. 3 is a side view of one of the identical profile members used to construct the embodiment shown in FIG. 1.

A side-view of profile shape 20 is shown on FIG. 3. Left channel 22' is constructed of two vertical shoulders 30 and 31 on surface 21' with the bottom of channel 22 being a continuation of rim 32 which extends peripherally around shape 20 to provide a pleasing appearance and reinforcement of each profile shape 20. Channel 23' is similarly constructed by providing vertical shoulders 32 and 33, the latter of which is partially used to form channel 24' along with shoulder 34 and bottom shoulder 39. Bottom shoulder 38 prevents the sleeve from falling down when inserted in channel 23'. In a similar fashion channels 25', 22, 23, 24 and 25 are constructed.

It is preferred that the entire profile shape 20 be molded as one piece to form the various elements described herein. The composition of profile shape 22 may be of any durable material although plastics and particularly thermoplastic polymers are preferred including, but not limited to polymers of methyl methacrylate, styrene, acrylonitrile, vinyl chloride, carbonates, including the bisphenol-A version, and other thermoplastic polymers of like quality and any copolymer and interpolymer of the hereinabove or the like which is generally suitable for applications of this type. It is preferred that the material be transparent although it may be lightly tinted with color. Transparency is not critical to this part and termoset plastics, metal or cellulosic type materials may be used to construct the embodiments of this invention.

As illustrated in FIG. 3, channels 22', 23', 24' and 25' are interspaced horizontally to varying distances to take advantage of the viewing angle, the size of the pictures to be inserted and the size of the sleeves. It is critical to this invention that when a plurality of channels are used to hold the sleeves, that each pair of channels be offset horizontally to allow the lower sleeves to be inserted without interference of the upper channels. Thus, the horizontal distance between channels 23' and 24' is more than satisfactory and the channels may use common shoulders as illustrated and may partially overlap horizontally. As illustrated by the distances between channels 22' and 23' and between 24' and 25', the horizontal distances between channels may be significantly greater. In general, the larger the picture capacity of picture holder 10, the smaller the horizontal distance between the channels.

As also illustrated in FIG. 3, the vertical distances between the tops of the channels vary considerably depending upon the size of the picture, the size of the sleeve, the viewing angle, the capacity desired, and the profile shape design. As illustrated, there is a significant vertical overlap between channels 22' and 23', but the size of sleeve 50 chosen for insertion in channels 22 and 22', provides for little overlap when the viewing angle is considered due to the horizontal offset between channels 22' and 23'. There is little vertical overlap between channels 23' and 24'. In this embodiment the vertical distance between the bottoms of the channels is essentially equal so that it is designed for pictures of the same approximate height but of differing widths.

Complimentary slots 26 and 27 are shown as being essentially identical. Interlocking lugs 28 and 29 are extensions of reinforcement ribs 35 and 36. Circular nub 37 on the bottom edge of shape 20 is provided to engage in a stand when picture holder 10 on a horizontal surface, such as a "lazy susan" type device.

Figure 4:
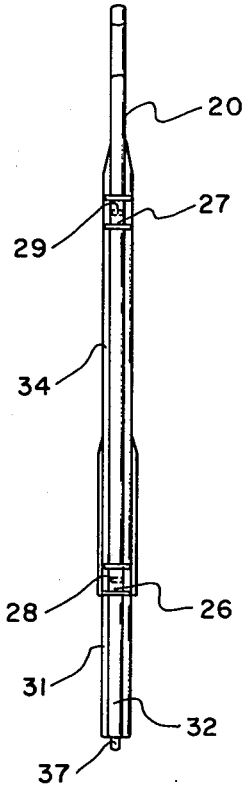
FIG. 4 is an edge view of the profile member of FIG. 3.

A side-view of profile shape 20 is illustrated in FIG. 4 showing rim 32 as well as shoulders 31 and 34. Complimentary slots 26 and 27 interrupt rim 32 along with interlocking lugs 28 and 29. Circular nub 37 is illustrated.

Figure 5:
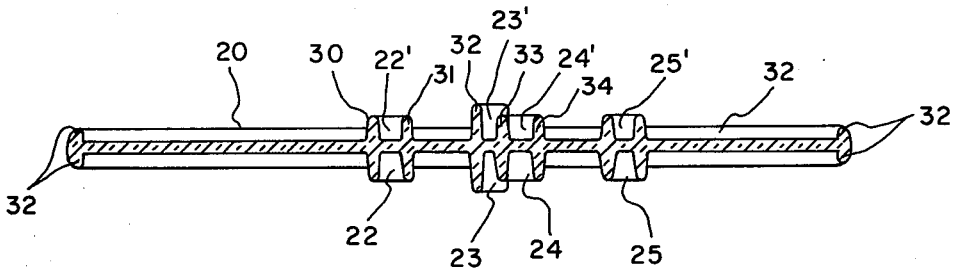
FIG. 5 is a cross-sectional view along Line 5—5 of FIG. 3.

A cross-sectional view of FIG. 5 along lines 5—5 of FIG. 3 shows the internal construction of the eight channels, four to each side of this embodiment of profile shape 20. It is illustrated how shoulders 30 and 31 form channel 22' and shoulders 32, 33 and 34 form channels 23' and 24'.

Figure 6:
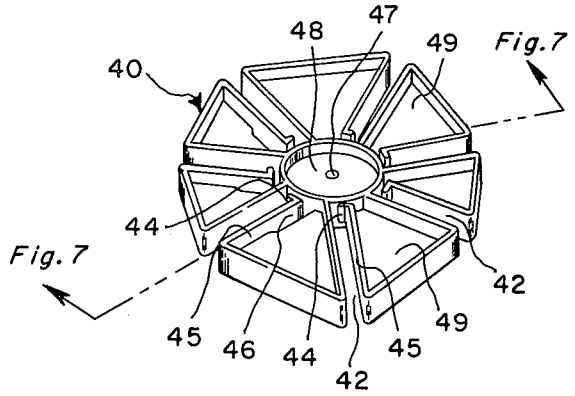
FIG. 6 is a perspective view of one of the two identical interconnecting hubs used to interconnect the profile members as illustrated in FIG. 2.

Interconnecting hub 40 is illustrated in the perspective drawing FIG. 6 showing seven interconnecting complimentary radial slots 42, all identical except for the circumferential position. Wall 45 is partially springably detended by providing space 46 which allows lug 44 to springably engage the respective interlock lug 28 on profile shape 20. Hole 47 allows a string to be inserted to hang hub 40 and/or hub 41 and thus the entire picture holder 10 from above.

Figure 7:
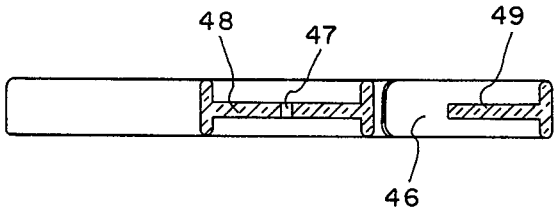
FIG. 7 is a cross-sectional view along line 7—7 of FIG. 6.

FIG. 7 is a cross-section along lines 7—7 of FIG. 6 showing the center section 48 and the partial cutout of face 49 to form space 46 to allow spring detent wall 45 to move upon insertion and interconnect with profile shape 20.

Figure 8:
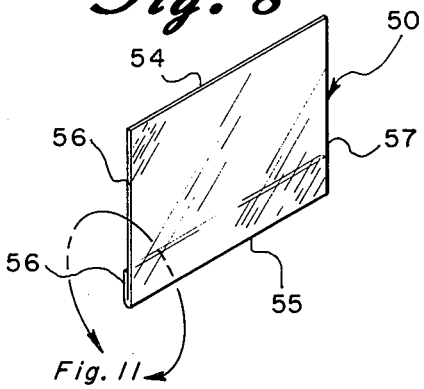
FIGS. 8, 9 and 10 illustrate perspective views of sleeves for holding pictures which are inserted in the device as in FIG. 1.
Figure 9:
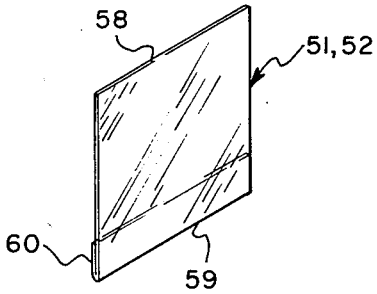
Figure 10:
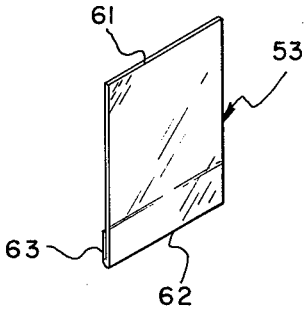

FIGS. 8, 9 and 10 illustrate sleeves suitable for insertion in picture holder 10 to frame and hold pictures in the device. Sleeve 50, as illustrated in FIG. 8 is a bifolded sheet of transparent vinyl chloride polymer. The sleeves may be produced of any essentially clear sheet and many plastic polymers are satisfactory, including cellulose acetate film, cellulose acetate butyrate and other polymers. Throughout this specification, the term transparent is used to include those materials that in the thickness used allow viewing of a picture through the material. Thus, translucency and color are tolerated if the criteria is met. The sleeve is formed of sheet with bend 54, and with bend 55 and with overlap 56 to form a sleeve to hold pictures and the like. When the sleeve 50 is inserted in channels 22 and 22' with the open ends in the channels, a picture inside the sleeve is suitably held and framed in the picture holder.

In this embodiment, sleeves 51 and 52 are identical inasmuch as the horizontal distance between channels 23 and 23' and the distance between channels 24 and 24' are close so as to allow the depth of the channels to make up the difference in the size of the respective sleeves. Again, sleeves 51 and 52 are bifolded sheets formed by bends 58 and 59 to provide overlap 60 to suitably hold the pictures. The size of the sleeves is dependent upon the number of profile shapes, the size of the profile shapes, and the horizontal spacing between the respective channel pairs. If it is desired to have sleeves of the same size so as to hold pictures of essentially the same size, the channels are horizontally spaced close together. If, on the other hand, it is desired to have sleeves of differing size, horizontal spacing of channels provides for this choice. Both embodiments are illustrated in picture holder 10. It is apparent that the picture holder 10 may hold sleeves all of the same size or it may hold sleeves of a variety of sizes, all depending upon the design of profile shape 20 and on the horizontal placement of the respective channels.

Sleeve 53 is illustrated in FIG. 10, it being the smallest of the sleeves in this embodiment. It is again formed from the bifolded sheet with two bends 61 and 62 with overlap 63 to form the top and bottom of the sleeve. Sleeve 53 is inserted in channels 25 and 25' to frame the pictures held within the sleeve.

Figure 11:
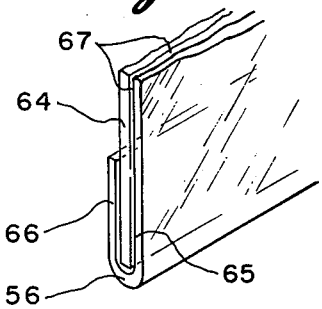
FIG. 11 is an expanded perspective view of a corner of the sleeve in FIG. 8.

A close up of the overlap bend of sleeve 50 in FIG. 10, is shown in FIG. 11. One end 64 of the clear vinyl chloride sheet is shown between face 65 and the other end 66 formed by bend 56. Thus formed, sleeve 50 provides space 67 in which a picture may be inserted to be framed and protected by the sleeve and the shoulders of profile member 20.

It should be understood that while the present invention has been described in considerable detail with respect to specific embodiments it may be used in other ways without departure from the spirit of the invention or the scope of the appended claims.

We claim:

1. A picture holding device for holding transparent sleeves in which pictures may be inserted, comprising:

(a) six to eight profile members, each member having two faces, (b) an interconnecting means to connect the profile members to form a unit wherein the profile members project radially outward to form spaces between adjacent pairs of profile members, the interconnecting means comprising two identical discs, each with six to eight slots, equal to the number of profile members to be interconnected, these slots interconnecting with two complimentary slots on each profile member.

(c) three to five sleeve holding channel pairs on opposing faces of the adjacent profile member faces comprising two essentially vertical sidewalls extending outwardly from the faces of the adjacent profile members, the channels forming a plane tangent to the circumference of a circle centered about the central axis of the picture holding device.

2. The picture holding device of claim 1 wherein there are four sleeve holding means for each profile member.

3. The picture holding device of claim 1 wherein the profile member has a profile shape smaller at the top and larger at the bottom.

4. The picture holding device of claim 3 wherein the shape of the profile is chosen such that when the profile members are interconnected to form the picture holding device, it is in the shape of a bell.

5. The picture holding device of claim 1 wherein the profile members including the sleeve holding means are molded in one piece of a polymer comprising polymerized methyl methacrylate and the sleeves are bi-folded transparent vinyl chloride polymer film.

6. The picture holding device of claim 1 wherein the sleeve holding channels have bottom walls which hold the sleeves terraced equidistantly from each other in a vertical direction.

7. The picture holding device of claim 1 wherein the distances between adjacent pairs of channels, differ from pairs at varying heights to hold varying sized sleeves terraced in arrangement to display the larger sleeves at the bottom and the smaller at the top.

8. The picture holding device of claim 1 wherein the vertical planes between the pairs of channels are tangent to the circumference of a circle centered about the central axis of the picture holding device and are spaced varying distances from that central axis being terraced from the widest plane at the bottom to the narrowest plane at the top.

* * * * *